United States Patent [19]

Schneider

[11] Patent Number: 4,712,594

[45] Date of Patent: Dec. 15, 1987

[54] LIQUID STORAGE AND DELIVERY SYSTEM FOR PROTECTIVE MASK

[76] Inventor: Wesley Schneider, 1030 N. State Pkwy., Apt. 50-F, Chicago, Ill. 60610

[21] Appl. No.: 821,792

[22] Filed: Jan. 23, 1986

Related U.S. Application Data

[63] Continuation-in-part of Ser. No. 654,121, Sep. 26, 1984, abandoned, which is a continuation-in-part of Ser. No. 462,614, Jan. 31, 1983, Pat. No. 4,503,310.

[51] Int. Cl.[4] ..... B65B 3/04

[52] U.S. Cl. ..... 141/114; 141/243; 141/392; 128/206.22; 138/149; 206/524.8; 220/66; 220/85 B; 220/403

[58] Field of Search ..... 141/10, 19, 37, 67, 141/68, 114, 329, 330, 234–247, 313–317, 346–382; 222/175, 207, 383, 464; 150/55; 215/1 C; 383/100, 903; 220/375, 85 B, 66, 403; 138/149; 128/206.22; 210/266; 206/524.8

[56] References Cited

U.S. PATENT DOCUMENTS

| | | | |
|---|---|---|---|
| 2,804,995 | 9/1957 | Fee | 215/1 C |
| 2,844,275 | 7/1958 | Keller | 220/375 |
| 2,950,030 | 8/1960 | McConnohie | 222/207 |
| 2,999,500 | 9/1961 | Schürer | 220/85 B |
| 3,143,429 | 8/1964 | Swanson et al. | 215/1 C |
| 3,157,204 | 11/1964 | Phillips | 138/149 |
| 3,396,762 | 8/1968 | Paton | 220/85 B |
| 3,490,656 | 1/1970 | Taschner | 222/464 |
| 3,731,717 | 5/1973 | Potash | 141/349 |
| 3,788,369 | 1/1974 | Killinger | 141/114 |
| 3,802,464 | 4/1974 | Frank et al. | 220/85 B |
| 3,834,570 | 9/1974 | Barr | 383/100 |
| 3,960,294 | 6/1976 | Bernard | 222/175 |
| 4,298,475 | 11/1981 | Gartner | 210/266 |

*Primary Examiner*—Houston S. Bell, Jr.
*Attorney, Agent, or Firm*—Jerry A. Schulman

[57] ABSTRACT

A liquid storage and delivery system for use with protective masks having hand-operable bulb siphon pumps in line with conduits extending from a canteen assembly to the drinking mouthpiece of the protective mask. The system includes structure to allow a user to drink directly from a central storage/dispensing reservoir by connecting the conduits directly thereto, and also allows the canteen assembly to be refilled from the reservoir while maintaining the system's protective integrity.

24 Claims, 22 Drawing Figures

LIQUID STORAGE AND DELIVERY SYSTEM FOR PROTECTIVE MASK

This is a continuation-in-part of my application Ser. No. 654,121, since abandoned filed on Sept. 26, 1984, which is a continuation-in-part of my application Ser. No. 462,614, filed on Jan. 31, 1983, since issued as U.S. Pat. No. 4,503,310 on Mar. 19, 1985.

BACKGROUND OF THE INVENTION

This application relates generally to delivery systems for liquids and, more particularly, to a system providing for the delivery of drinking liquids to a protective mask enabling the wearer of the mask to create a closed system for ingestion without exposing the liquid to contamination.

Use of chemically active and debilitating substances requires the use of protective masks and clothing, making normal eating and drinking impossible. When using toxic chemicals, a workman may have to plan a work schedule which provides for appropriate breaks, including time to detoxify such protective clothing and allow its removal. However time-consuming and inconvenient such procedures may be, they deal with a far less life-threatening situation than that encountered by a person under attack by chemical agents. The immediacy and reliability of the protective measures required under such attacks exemplifies most sharply the inadequacies of existing liquid delivery systems. Accordingly, with the understanding that commercial, or non-combat use of the present invention is contemplated, use under combat situations will be preferably presented.

Chemical warfare has, in the past, been demonstrated to be of devastating physical and psychological effect. Chemical agents, such as toxic gases are pervasive, difficult to detect, create immediate and long-lasting disabling effects, and are available in substantial and sophisticated forms to cause a wide range of injury and/or disability from narcosis, discomfort, and disorientation all the way to paralysis and death.

To defend against such combat measures, attempts have been made to create protective clothing and protective masks in order to insulate a wearer from the effects of offensively-utilized tactical chemical agents. Where such clothing and/or masks are effective to shield or filter the particular chemical agent involved, the wearer will be protected so long as the integrity of the protective garb remains intact.

It is characteristic of chemical agents that, once deployed, they may remain effective for a substantial period of time afterward before naturally occurring atmospheric and meteorologic action either disperses, dilutes, or removes them from the environment. As an example, certain chemical substances dispensed in aerosol form may be degraded or altered by the action of direct sunlight, while others, being water soluble, may be "scrubbed" from the atmosphere and/or landscape during rainstorms. Nevertheless, it is an accepted consequence of such forms of warfare that protective clothing, once donned, may have to be worn for an indeterminate amount of time until it is established that the danger to the wearer has abated.

Protection of the wearer is only one aspect of such protective garments. Another consideration is the ability of the wearer to carry out assigned duties even when prolonged use of such protective clothing is required. This means that such garments must not only enable the wearer to see and to communicate, but, advantageously, must also make some provision for the ingestion of liquids in order to replace those liquids lost by the body through perspiration which may be heightened by the wearing of protective clothing of impermeable or semi-permeable characteristics, and by increased or stimulated body reactions resulting from participation in frightening or stressful situations.

Exemplary of a protective mask designed to meet such emergency situations is the mask illustrated and discussed in U.S. Pat. No. 3,731,717, issued May 8, 1973. Other versions of such masks include a full, overlapping hood which completely covers the wearer's head, neck, and portions of the shoulders, but which depends for its effectiveness upon a system of air filtration typified by the mask shown in the above-mentioned patent.

The wearer's incoming air supply is directed through a canister containing activated charcoal or other mechanical and chemical filtering agents selected to be effective against the particular chemical agent or agents expected to be encountered. Other portions of the mask must form a substantially air-tight protective fit about the wearer's face and head. This is important because some chemical agents are absorbed not only through the respiratory system, but may enter the body through exposed skin surfaces. Transparent eye pieces are provided to enable the wearer to see through the mask, however, the range of vision is somewhat obstructed by the nontransparent portions of the mask.

Thus, when the protective mask is properly in place, the wearer is unable to eat or drink normally without breaching the integrity of the mask's protective features. This poses a critical problem, particularly with respect to body fluids, which must be constantly and continuously replenished to avoid the serious effects of dehydration.

The above-mentioned patent provides a means by which the wearer of such a mask may ingest liquids without requiring removal of the mask. As a part of the mask construction, a mouthpiece mounted on the inside of the mask is positionable to engage the wearer's mouth. An inlet tube attached to the mouthpiece extends through an air-tight fitting to the exterior of the mask, with the tube terminating in a plug.

A standard U.S. Army canteen is fitted with a cap having a built-in fitting to accept the plug formed at the end of the inlet tube so that when the plug is inserted into the cap, a closed system is created which includes the interior of the canteen, the interior of the cap and plug the inlet tube, and the mouthpiece. However, use of such a system provides serious inconveniences and disadvantages which serve to complicate the procedure for obtaining such liquids and, in the case of a combat soldier, exposes the soldier to unwarranted hazards and dangers encountered during the conduct of the soldier's assigned mission.

As set forth in said patent, and as set forth in U.S. Army instruction manuals, such as No. 3-54 EL/2, at ORDG. 1038-29, pp. 2–49 to 2–50, use of the above-described system requires the soldier to remove the canteen from its holder, remove the protective flap covering the cantten cap, visually locate the plug at the end of the drinking tube and visually locate the cap on the canteen, insert the plug into the cap, and elevate the canteen above the level of the mouthpiece so that the liquid will flow under the influence of gravity from the canteen, down the tube, and through the mouthpiece. This type of closed system is further complicated because the canteen itself cannot be vented to the atmosphere or else the liquid contained therein will become contaminated by the chemical agent present. This means that constant flow will not take place by gravity alone.

In order to remedy this situation, the user of such a system is instructed to blow through the mouthpiece in order to inject air into the canteen, and to thereafter suck liquid from the canteen via the drinking tube and mouthpiece. Such blowing and sucking operations are tiring and time-consuming, and seriously limit the rate at which the liquid can be drained from the canteen. Under conditions which have already created physical and psychological stress, such as those encountered on the battlefield, any additional physical effort should preferably and necessarily be avoided.

Another disadvantage of the above described system is that the user must use two hands, which means whatever activity the user is carrying out must be interrupted. The user must also raise the canteen above the level of the mouthpiece and hold it there in a tiring and awkward posture. Apart from the physical effects and consequent fatigue, this means that the user may be forced to maintain a relatively vulnerable posture in order to perform so simple an act as the taking of a drink.

When the user has finished drinking, the plug must be removed from the canteen cap, the protective flap must be sealed across the cap socket, and the canteen must be returned to its holder. During this operation, of course, the cap and plug are exposed to possible contamination by any chemical agents present in the air, and must be decontaminated prior to connection every time a drink is required.

Given the nature of certain chemical agents, the toxic effects of such agents are enhanced when they are utilized at night, particularly those agents which are degraded by higher temperatures or direct sunlight. This means that use of protective garments and liquid delivery systems for such garments may most frequently occur when visibility is at its poorest, thereby jeopardizing the secure and correct decontamination and connection of the above-described system.

Accordingly, the need exists for a liquid delivery system which would substantially overcome the above-identified problems, thereby adding to the security and continued health and well being of one forced to adopt the use of such protective clothing and masks for indeterminate periods of time. The need also exists for such a delivery system to be readily adaptable to protective equipment already in widespread use, making deployment of such a system compatible to both old and newly-manufactured equipment.

BRIEF DESCRIPTION OF THE INVENTION

A fluid delivery system suitable for use with protective masks includes a delivery tube sealed, at one end, to the drinking mouthpiece contained within the mask and attached at its other end to a bulb-type siphon pump. A supply tube is attached liquid-tightly at one end to the bulb siphon pump and, at the other end, to a plug member.

A canteen structure is provided with a removable cap having a socket which cooperates with the plug member at the end of the supply tube to form an air-tight positive fit when the plug is inserted into the socket. Means are provided in the canteen construction to enable liquid to be withdrawn from the canteen without requiring venting of the canteen's contents or injection of air into the canteen in order to equalize the air pressure within the canteen with the atmosphere. In one version of such a construction, the canteen structure includes a rigid outer wall and an inner pliable liner within which the liquid is carried, and a selectively openable and closeable valve enabling the air pressure between the inside and the outside of the rigid portion of the canteen structure to be equalized while the liner collapses as liquid is withdrawn therefrom. In another version, the canteen structure is formed with sidewalls fashioned in a flexible, bellows-like configuration, giving the canteen structure sufficient flexibility to enable the canteen structure to flex during the withdrawal of liquid therefrom without sustaining permanent deformation or damage due to material fatigue.

Another feature of the present invention is a flexible drain tube attached to the interior of the canteen structure cap and extending into the canteen, and having a weighted end distal from the cap whereby the drain tube will automatically drop to the lowermost portion of the canteen, i.e., that portion of the canteen at which the liquid level is at its highest regardless of the position in which the canteen is held.

The supply tube is preferably coiled to present a compact, easily stored construction when not in use, and which may be stretched to connect the mask and the canteen structure, when the canteen structure is carried in a typically belt-worn carrying case. The canteen then need not be removed during the drinking operation. A protective insulating sheath may be used to cover the supply tube as an added measure of protection against freezing, condensation, physical damage, or to coordinate use of the system with selected uniforms or camouflage requirements.

An additional chemcial and/or mechanical filter may be inserted to provide an additional measure of protection against contamination of the liquid.

Hand-pumping of the bulb-type siphon pump thus provides a supply of liquid extending in a path from the interior of the canteen structure to the users mouth without being exposed to the atmosphere and, thereby, any chemical agent or contaiminant present. The pump may be supplied with a check valve preventing the contents of the supply tube from draining back into the canteen between uses, thus making it unnecessary to "prime" the system each time it is used.

Yet another aspect of the present invention involves the provision and use of a central reservoir or drinking-/refilling tank structure to enable a user to drink therefrom by connecting the supply tube directly thereto, or to refill a depleted canteen by connecting a refill tube thereto and applying a sufficient pressure differential between the reservoir and the interior of the canteen to refill the canteen.

A preferred embodiment of this aspect of the present invention includes a flexible can liner fluid-tightly attached to the interior of the cap for the reservoir, one or more pin receiving plugs of the type interconnectable with the M1 cap drink pin presently used on drinking systems for protective masks, and a dip tube or straw extending from each such receiving plug into the interior of the liner. A separate transfer tube may be utilized to refill a canteen directly from the reservoir, with each end of the tube having the mating M1 cap drink pin assembly thereon, enabling connection at the reservoir cap and the canteen cap. Refilling may be accomplished by gravity flow or by pressure-assisted flow.

BRIEF DESCRIPTION OF THE DRAWINGS

These and further aspects of the present invention may best be understood by referring to the accompanying drawings, wherein.

DETAILED DESCRIPTION OF THE INVENTION

Figure 1:
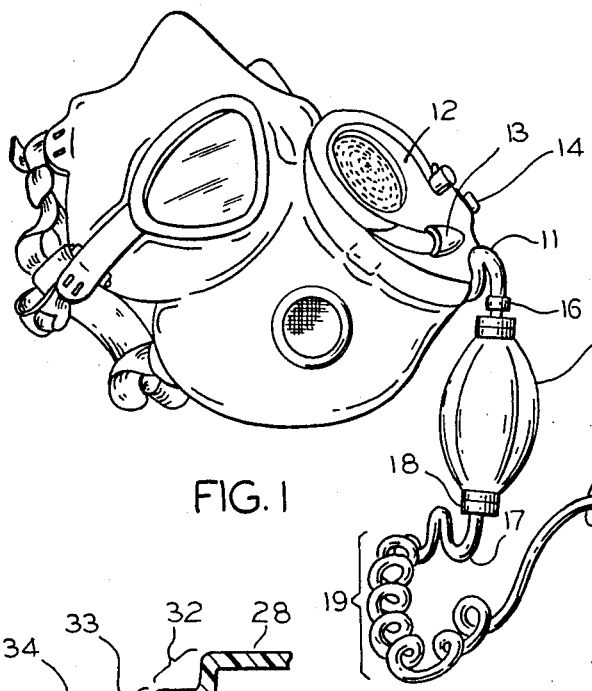
FIG. 1 is a view of the system of the present invention showing connection of the system to a protective mask.

Referring now to FIG. 1, the numeral 10 indicates generally a protective mask of the type hereinabove described. One such mask currently in distribution by the U.S. government is identified as the M17A1 mask. As an integral part of the mask structure, an inlet tube 11 extends, via voice transmitter housing 12 and fluid-tight fitting 13 to the interior of mask 10 where it is liquid tightly secured to a drinking mouthpiece not herein specifically shown. Connection of the inlet tube to the mouthpiece may be made in any number of conveneient or well-known manners to provide a permanent and durable liquid-tight fit. Typically, the mouthpiece is hinged and spring-biased to remain away from the user's mouth during normal conditions. An operating tab 14 extending to the exterior of mask 10 may be used to move the mouthpiece down toward the user's mouth where it may be grasped by the user until drinking is completed. Upon release, the tube will return to its original rest position within mask 10.

Inlet tube 11 is attached at its other end to bulb siphon pump 15 at fluid tight fitting 16, again, by any known method which provides a durable and liquid-tight connection. Pump 15 is preferably formed of heavyweight rubber or rubber-like material which will flex easily when compressed by the user's hand, and which will retain its liquid-tight properties over extended periods of time.

Figure 2:
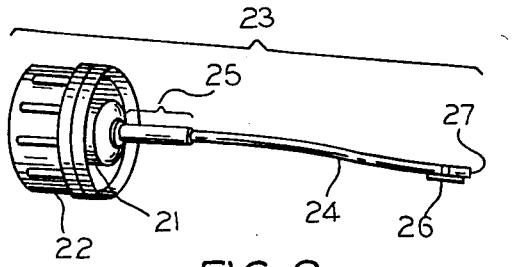
FIG. 2 is a perspective view of the cap and drain tube assembly insertable into the canteen structure.

The inlet side of pump 15 is attached to supply tube 17 at fluid-tight fitting 18. Supply tube 17 is preferably permanently coiled about a substantial portion of its length, as shown at 19, so that it may be compactly stored yet may be extended over a relatively long distance. Supply tube 19 terminates in plug 20 which, in the present preferred embodiment, is of a type already known and in use, its distinguishing characteristic being that it cooperates with a socket construction 21 which, in the preferred embodiment illustrated, is an integral part of canteen cap 22. As an example, the plug structure shown in U.S. Pat. No. 3,731,717 may be utilized. Plug 20 may also be referred to as a cap drink pin, and socket construction 21 may also be referred to as a cap drink plug or a pin receiving plug. When assembled, plug 20 extends into canteen cap 22 as seen in FIG. 2. Cap cover 52 may be provided as hingedly attached to cap 22 to cover and protect socket assembly 22 when not in use.

Use of mechanical restraining means, such as a rubber strap 57 or retaining spring, may be attached at one end to cap 22 and at the other end to plug 20 to prevent accidental disengagement.

Referring now to FIG. 2, a preferred version of cap construction 23 includes canteen cap 22, socket assembly 21, and drain tube 24 liquid tightly connected to socket assembly 21 as shown in 25. Again, connection of tubes such as drain tube 24 to socket assembly 21 may be accomplished in a number of well known manners to perform the function required in the present invention.

Drain tube 24 is formed of a thin, flexible, plastic material selected to avoid stiffening or hardening in low temperatures, and includes a ballast piece 26 positined proximate inlet 27 of drain tube 24. The weight of ballast piece 26 is selected to deflect drain tube 24 by the force of gravity downward within canteen 28 such that inlet 27 will be positioned at that point within canteen 28 where undispensed liquid will also be drawn by gravity. This result will obtain regardless of the position in which canteen 28 is placed.

Referring now to FIG. 1, numeral 28 indicates a canteen construction which, in a preferred embodiment, is formed from a heavy gauge polyethylene-type plastic material which, when properly shaped, may be flexed many times without suffering material fatigue and failure.

Figure 5:
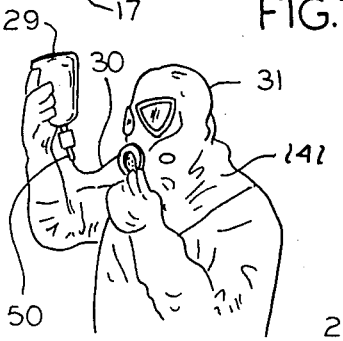
FIG.5 (PRIOR ART)
FIG. 5 is a graphic illustration of the prior art.

FIG. 5 illustrates generally use of a standard canteen 29 manufactured from the same type of material molded, however, into an essentially rigid structure not designed to flex during use. As will be hereinbelow discussed, the capability of canteen 28 to successfully absorb such flexing action is an important feature of the present invention.

As discussed above, conventional practice requires the withdrawal of liquid from canteen 29 via suction tube 30 directly into the user's mouth. The suction force required to draw liquid from canteen 29 is provided by the user sucking on the internal mouthpiece of protective mask 31.

As is well known, with a structure having rigid walls, as the contents of the structure are withdrawn by suction, a partial vacuum is created within the structure as the volume of air originally present in the structure expands to fill a larger volume. When the pressure differential between the interior pressure of the structure and the external atmospheric pressure becomes too great, the structure may collapse or permanently deform. In order to prevent this occurrence, as described above, users of the system illustrated by FIG. 5 must alternately suck liquid through drinking tube 30 and blow air through drinking tube 30 in an attempt to equalize the pressure inside canteen 29 with the outside atmospheric pressure.

Figure 3:
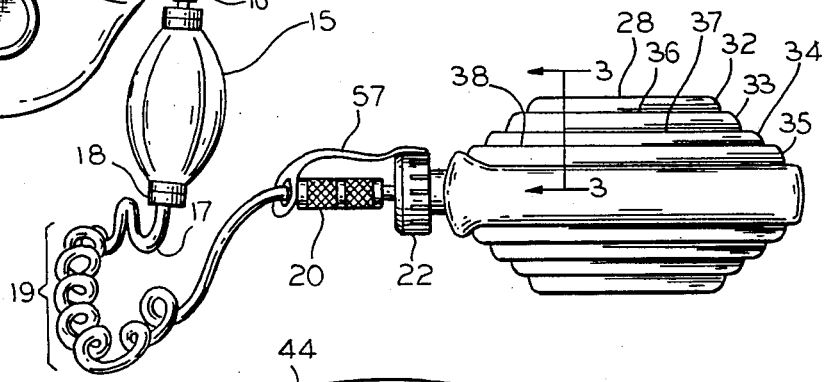
FIG. 3 is partial sectional view along 3—3 of FIG. 1.
Figure 3:
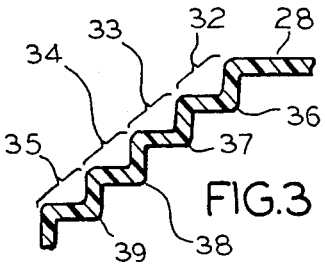

Referring now to FIG. 2 and FIG. 3, canteen 28 of the present invention is preferably molded with a cross-section of individual stepped sections such as those shown at 32, 33, 34 and 35 joined at bends, or "knees" 36, 37, 38 and 39. The combination of the stepped sections and bends enables the sides of canteen 28 to flex or partially collapse in a bellows-like manner in response to the differential in pressure caused by the draining of liquid from canteen 28. It is a well known characteristic of such plastic materials that they retain a living memory of the original shape within which they were molded and, when such bends are properly molded, may be distorted from and returned to said original shape many times without sustaining material fatigue or structural damage.

Figure 4:
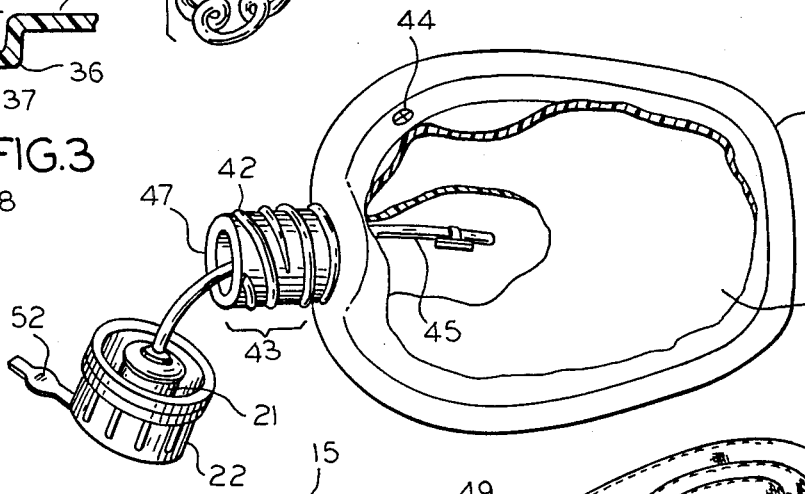
FIG. 4 is a partial sectional view of one aspect of the present invention illustrating a canteen structure having an interior liner.

Referring now to FIG. 4, in yet another version of the present invention, a canteen structure may include a more or less conventional rigid outer shell 40 within which a thin, flexible bag-like liner 41 may be disposed. The liquid to be dispensed will be contained within liner 41. Preferably, liner 41 may be of a size to fill the interior of shell 40 and extend through the neck 42 of said shell, as at 47, thereafter to be sealed off by screwing cap 22 onto the threads 43 typically formed on the exterior surface of neck 42.

As shown at 44 of FIG. 3, a valve structure, or plug, may be utilized to allow the interior of shell 40 to communicate with the atmosphere. Thus, as liquid is drawn through drain tube 45 from liner 41, liner 41 is free to collapse within rigid shell 40, allowing easy withdrawal of the liquid. Valve or plug 44 may be constructed so as to create a liquid-tight seal when in the closed position so that shell 40 may be used as a canteen in a conventional manner without a liner where protection from contaminating agents is not a consideration.

Once liner 41 is completely evacuated, it may be discarded and a fresh, sterile, liner inserted and refilled to provide another safe source of liquid.

Preferably, inlet tube 11, pump 15, supply tube 17, and plug 20 remain integral with and permanently attached to mask 10, and may be conveniently and unobtrusively stored with mask 10 in a more or less conventional carrying container.

Figure 6:
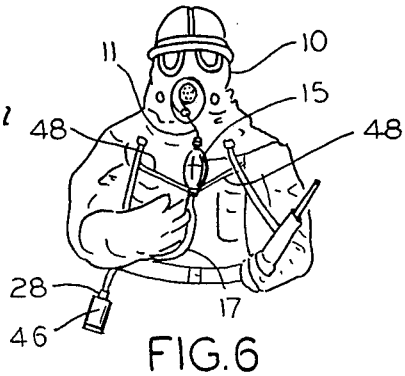
FIG. 6 is a graphic illustration of the use of the present invention.

Use of the present invention may be illustrated by referring to FIG. 6. After donning mask 10, the user stretches supply tube 17 to enable plug 20 to reach canteen 28 carried, for example, in holder 46. After carrying out any prescribed decontamination of plug 20 and/or cap 22, the user inserts plug 20 into cap 22 to complete a flow path from canteen 28 to the drinking mouthpiece in mask 10.

By grasping pump 15 and squeezing, liquid will then be drawn from canteen 28 and will be delivered to the user via supply tube 17, inlet tube 11, and the mouthpiece of mask 10. Such delivery requires use of only one hand to operate pump 15, and may be effected whether the user is in an upright, prone, or other position. Retainer straps 48 may be provided to anchor pump 15 to the user's clothing in order to keep the position of pump 15 constant.

Plug 20 may be left permanently attached until canteen 28 is empty, thus obviating the need to reconnect the system everytime the user wishes to drink.

Figure 7:
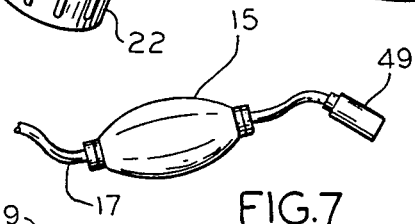
FIG. 7 is a partial perspective view of an adapter as part of the present invention.

FIG. 7 illustrates yet another version of the present invention, and consists of a construction including plug 20, supply tube 17, pump 15, and an adapter including a liquid-tight connection to pump 15 at one end, and a connector 49 corresponding in construction to socket assembly 21 at the other end. This version would enable attachment to the standard coupling arrangement now in use as shown in FIG. 5, and would convert such an arrangement to utilize the present invention. Standard coupling 50 would then be connectable to adapter 49 and, thereby, to the remaining components in the present invention, making immediate conversion of all existing protective masks feasible. Connection to adapter 49 may be done on an as-needed basis, under field conditions, using proper decontaminative procedures, or it could be done prior to such use on a permanent basis, to be stored with the mask. Permanent connection may be enhanced by utilizing an air-tight protective covering formed, e.g. from shrink-wrap material to prevent disconnection and as added protection from air-borne chemical agents.

Figure 8:
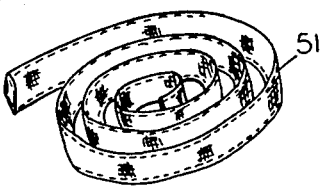
FIG. 8 is a perspective view of a protective sheath for the present system.

In FIG. 8, a protective sheath 51 is shown intended to provide protection to supply tube 17. Sheath 51 may be insulated to counter such problems as freezing of liquid in supply tube 17 in cold weather, or preventing condensation along supply tube 17 in humid weather. Protection may also be afforded against dirt, abrasion, or kinking. Sheath 51 may be provided in a variety of colors, based upon demands of uniform coloration or camouflage, or to indicate the conditions with which sheath 51 is intended for use, such as blue for cold weather, green for humid weather, and the like.

In use, sheath 51 may be drawn over plug 20 and extend to or past pump 15, and may be stored with mask 10 until its use is required. Other sheath constructions may be openable lengthwise, as by zippers, snaps, or the like, making use of such a sheath possible even after connection to canteen 28 has been made, without requiring disconnection and attendant decontamination of couplings.

Testing and use of the present invention and the system characterized by that shown in FIG. 5 has demonstrated the increased efficiency provided by the present invention. Test results show that liquid may be delivered to the user at twice the rate of the prior art system.

In yet another aspect of the present invention, provision may be made to include an additional in-line filtration element for those circumstances where the liquid itself is suspected of containing contaminating material. A cartridge type combined mechanical and chemical filter may be made a part of the present invention in a number of effective manners.

One such filter is of the general type wherein contaminants such as microorganisms and water-borne impurities are removed in a single pass from the liquid supply to the user's mouth by packings of both activated charcoal and microbicidal resins. One such construction is described in U.S. Pat. No. 4,298,475, and is sold under the trademark Pocket Purifier as manufactured by Calco, Ltd., of Rosemong, Ill.

Said filtration element is preferably provided in removable and replaceable versions insertable between canteen 28 and mask 10, and may find particular usefulness where canteens may have been filled with water which requires further treatment to make it safely potable, yet the canteens which hold the water cannot be opened for purification because of the presence of airborne chemical agents.

Figure 9:
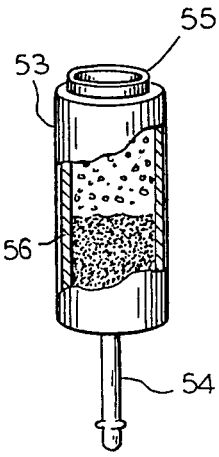
FIG. 9 is a partial sectional view of an in-line filtration cartridge holder.

In FIG. 9, a filtration cartridge holder 53 is shown, adapted at one end 54 to couple with cap 22 of canteen 28, and at its other end 55 to couple with plug 20. Holder 53 may have a filtration cartridge insert 56 of the general type described above removably held therein, which may be replaced when spent. While cartridge 56 may be placed wherever convenient, one advantage to placing it at canteen cap 22 is to avoid passible contamination of the system elements downstream of canteen 22. Use or replacement of holder 53 and cartridge 56 would be subjected to the same decontamination procedures followed when attaching plug 20 to cap 22.

Figure 10:
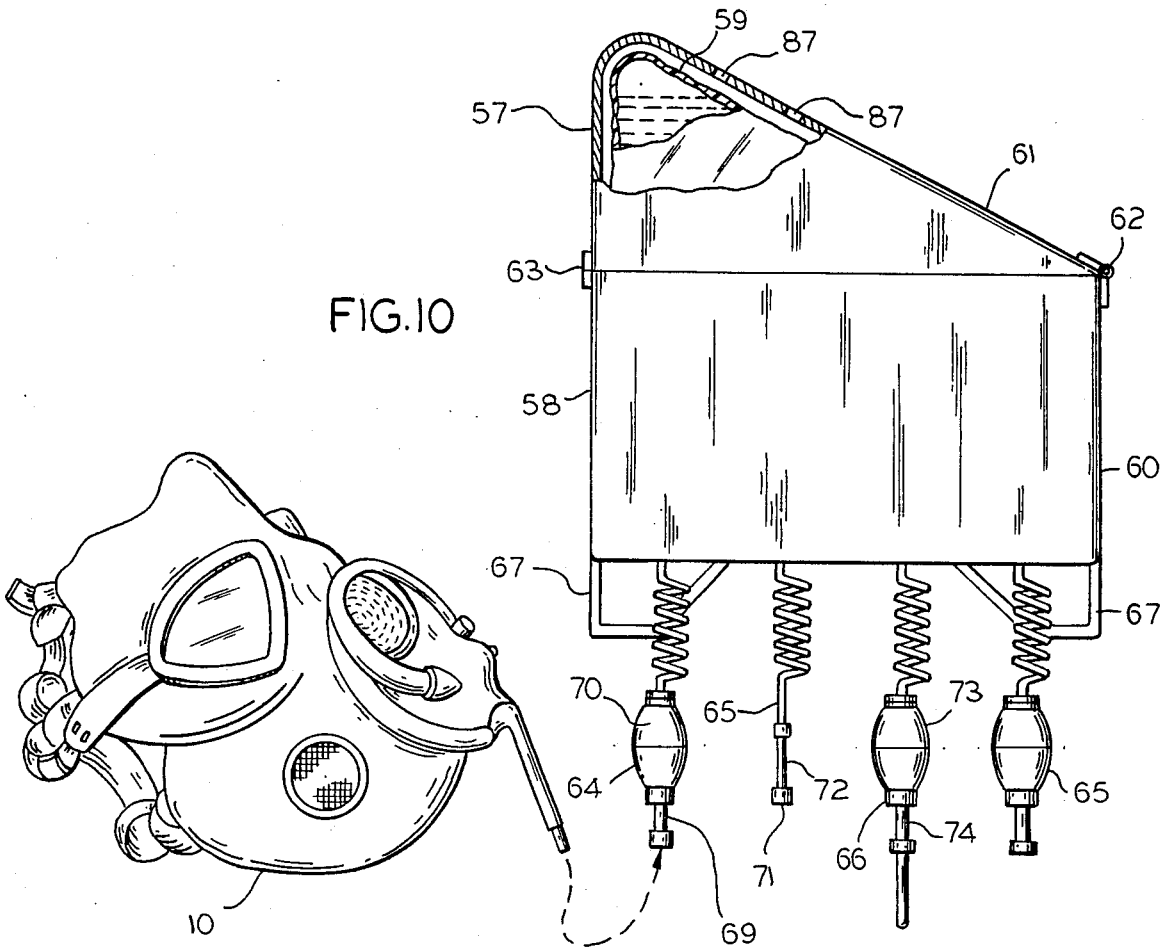
FIG. 10 is a front elevation of a preferred embodiment of a central storage/dispensing reservoir.
Figure 11:
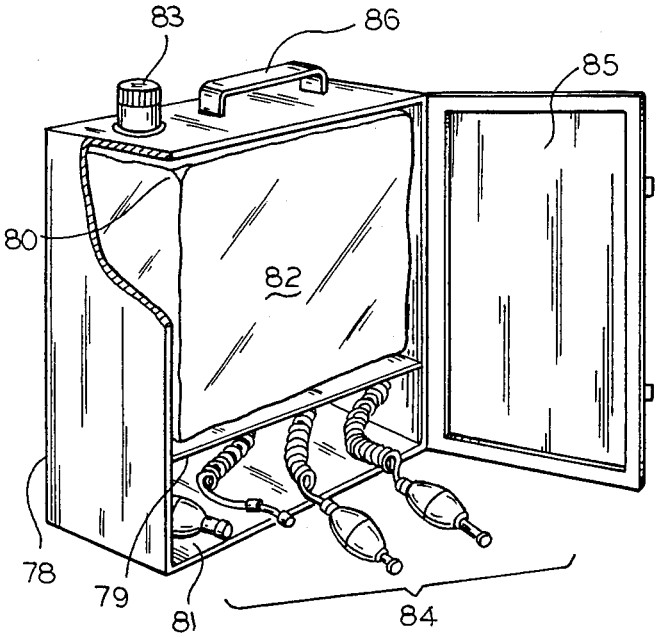
FIG. 11 is a perspective view of a second preferred embodiment of the reservoir of FIG. 10.
Figure 12:
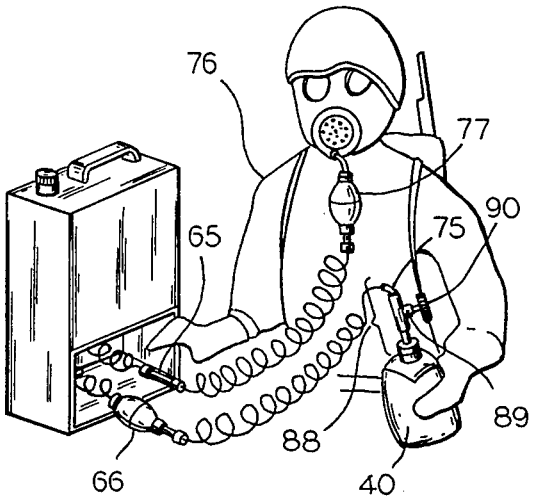
FIG. 12 is a schematic view showing a preferred use of the reservoir of FIGS. 10 and 11.

FIGS. 10-12 illustrate yet another aspect of the present invention. In FIG. 10, a reservoir assembly 57 is shown having a rigid outer case 58 within which a flexible liner 59 is disposed. In the embodiment herein shown, liner 59 is shaped to conform to the shape of case 58 when liner 59 is filled with liquid. Liner 59 is preferably formed from a heavy, high-density polyethylene material, or the like, which is sturdy and liquid-tight, and which allows the liquid-and-air-tight attachment thereto of values, couplings, and the like by, for example, heat welding or other commonly known fastening techniques.

Case 58 is formed with a lower case 60 to which a case lid 61 is attached at hinge 62, and a lock 63 secures lid 61 in the closed position. When opened, lid 61 allows the replacement of liner 59 when the liquid has been depleted therefrom, or when a different type of liquid must be substituted.

Connectors 64, 65 and 66 are attached liquid-tightly to or near the bottom of liner 59 and, in the preferred embodiment herein shown, extend through openings formed in the bottom of lower case 60 (not specifically shown herein). To allow for such extension, legs 67 may be attached to the underside of lower case 60.

Each of the above-mentioned connectors is adapted for use with some aspect of the mask delivery system heretofore described. As shown in FIG. 10, bulb connector 64 may be used to connect suction tube 30 of prior art mask 31 to reservoir assembly 57 by providing connector adaptor 68 attached to supply line 69. When thus connected, bulb siphon 70 is used to pump liquid from liner 59 to mask 31, to be ingested by the user thereof.

Where a user is wearing a mask assembly such as that shown in FIG. 1, the user may connect to reservoir assembly 57 via bulb connector 64 or straight connector 65, by inserting plug 20 into connector adaptor 68 or a similar connector adaptor 71 formed on supply line 72 of straight connector 65. When a user attaches to straight connector 65, liquid is pumped from liner 59 through use of bulb 15 of mask 10.

A third variation of connector is exemplified by refill connector 66, which includes a refill bulb siphon 73, a supply line 74, and a fill plug 75. Fill plug 75 is adapted to fit cap 22 of canteen assembly 40, as seen in FIG. 4. Bulb siphon 73 may then be operated to draw liquid from liner 59 and pump it into canteen 40.

In FIG. 12, there is shown a user 76 positioned to refill canteen 77 via connector 66, while drinking directly via connector 65, using mask bulb siphon 77.

It is contemplated that reservoir assembly 57 be permanently attached and positioned, such as to the interior or exterior of a vehicle. Where, however, it is desirable to have a portable source of liquid replacement, a construction such as that shown in FIG. 11 is contemplated. A rigid carrying case 78 is divided by a shelf 79 into upper and lower compartments 80 and 81, respectively. A liner 82, formed from similar material as that of liner 59, is disposed within upper compartment 80, and is shaped and sized to fill compartment 80 when filled with liquid. A filler cap assembly 83 may be formed as an integral part of line 82, and, as shown, is preferably accessible outside of case 78.

Lower compartment 79 accommodates a range of connectors 84 which are attached to liner 82, and attachable to masks and canteen assemblies as heretofore described.

Compartments 79 and 80 are closed off by door 85, and the entire assembly may be conveniently carried by handle 86.

To facilitate the refilling of canteens such as 40 of FIG. 4, means may be provided to apply pressure to the liners 59/82 of reservoir assemblies 57/78 respectively. Where such a reservoir is permanently attached, as to a vehicle, an externally maintained source of compressed air drawn from the engine motor may be applied to the interior of case 68, to collapse liner 59 as liquid is drawn therefrom. In the absence of such a supply of compressed air, gas cartridges such as those used to store $CO_2$ gas may be used.

Where liners 59/82 are supplied prefilled with liquid, gas may also be introduced into such liners at the time of packaging to create such additional pressure.

Where no external pressure source is needed, it is contemplated that liners 59/82 will collapse by atmospheric pressure alone, as liquid is withdrawn therefrom. Case 58 is preferably vented, as at 87 of FIG. 10, and said vents 87 are preferably of the type which will close when pressure is added to the interior of case 58.

Another preferred method of facilitating the refilling of canteens such as 40 involves use of an adaptor 88 such as that shown in FIG. 12, interposed between canteen 40 and plug 75. A valve 89 allows air selectively to enter canteen 40 and to be expelled from canteen 40 when displaced by liquid entering therein. A filter element 90 protects against the entry of airborne toxic agents, and it is comtempleted that filter element 90 may contain the same filter media as that used by mask 10 to protect the wearer from said toxic agents. A float valve (not herein specifically shown) is preferably included in said adaptor to prevent the liquid from reaching the filter element, if such protection is deemed necessary.

Where a reservoir, such as 57, is located within a vehicle, it is contemplated that users thereof may hook up to reservoir 57 continuously, without unhooking. In each instance of connection to a reservoir such as 57 or 78, it is expected that proper procedures will be followed to decontaminate the connectors, plugs, etc. required for making such connections.

The number and variety of connectors attached to an individual reservoir may, of course, be varied to suit anticipated conditions of use.

Figure 13:
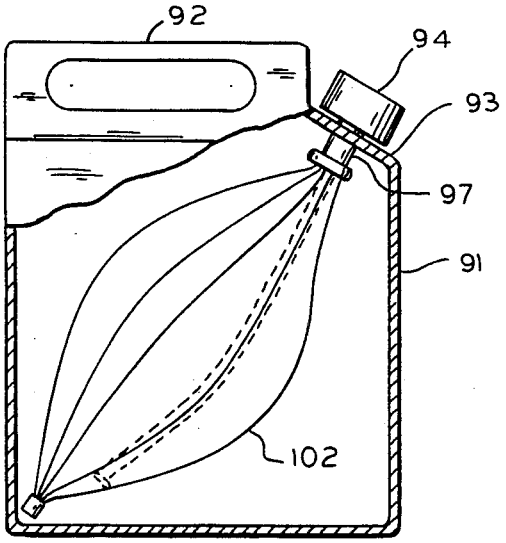
FIG. 13 is a view in partial section of a standard five-gallon water can illustrating a preferred use of the flexible can liner.

Yet another preferred embodiment of the present invention is shown in FIGS. 13 through 18 hereof. It has been found desireable to enable the modification of standard water-carrying vessels to accommodate the air-tight operating characteristics of the present invention. To that end, there is shown in FIG. 13 a standard, metal or blow-molded plastic water carrier or "jerry can" 91 of five-gallon capacity, having a carrying handle 92, a spout 93 and a spout cap 94. In ordinary use, spout cap 94 is threadably attached to spout 93, and when it is desired to fill can 91, spout cap 94 is threaded off and water is poured through spout 93 to fill the interior of can 91. Dispensing the water from can 91 is done by tipping the can so that the water exits spout 93.

Figure 14:
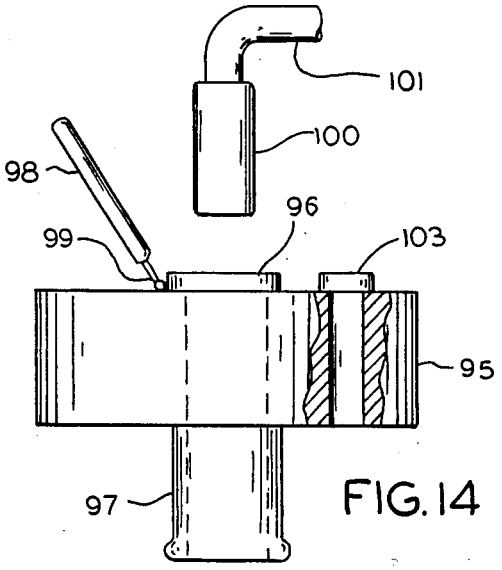
FIG. 14 is a view in partial section of the reservoir cap of 13 illustrating connection of a single tranfer tube thereto.

FIG. 14 is a view of a modified spout cap 95 having a cap drink pin receiving plug 96 formed integrally therewith, communicating directly to a hollow cap neck 97. A cover 98 may be provided to seal the opening to receiving plug 96, and is pivotally attached to cap 95 at hinge 99. Use of modified cap 95 will enable the connection of a cap drink pin 100 to plug 96, thereby completing an enclosed conduit or path through tube 101, pin 100, plug 96, and neck 97 for purposes which will be described hereinbelow.

As best seen in FIG. 13, a flexible, air-and water-tight can liner 102 is provided with an internal volume sufficient to enable the substantial filling of the interior space of can 91 when can liner 102 is filled with a potable liquid. A preferred can liner construction comprises a polyethylene bag having an externally applied layer of polyethylene terephthlates ("PET"), one commonly available form of which is manufactured by E.I. du Pont under the trade name and trademark "Mylar". The inner layer is preferably formed from polyethylene of an approved FDA grade for the storage of foods, while the outer PET layer is intended to provide a measure of resistance to chemicals and chemical agents.

One such can liner 102, which has been tested and found to be adequate is used by the Coca-Cola Company of Atlanta, Ga. for the storage of soft drink syrup, and use of such a bag together with a combination dip tube and quick disconnect valve is disclosed in U.S. Pat. Nos. 4,286,636, issued Sept. 1, 1981 and 4,445,539, issued May 1, 1984, both of which are assigned to the Coca-Cola Company.

As best seen in FIG. 13, can liner 102 has a single opening which is air-and liquid-tightly sealed to neck 97 of modified cap 95. It is to be understood that, for the purposes of the following discussion, the modified cap 95 has been substituted for the standard cap 94 as shown in Fig.13. A separate venting valve, such as that shown at 83 of FIG. 11 may be integrally formed as part of can 91 to allow air trapped in can 91 to be exhausted as can liner 102 is filled with liquid. An auxiliary filter (not herein shown) may be included as part of valve 83, where such a filter would protect against the particular contaminant present, to protect the interior of can 91. It should be remembered that once liner 102 is removed, can 91 can then be used conventionally under non-contaminated conditions. Alternatively, it is contemplated that can liner 102, after having been sealed to neck 97 of cap 95, may be inserted into can 91 and thereafter filled with liquid, allowing the air within can 91 to be exhausted through spout 93. After can liner 102 has been filled, cap 95 may be screwed onto spout 93 to close off can 91. It is contemplated that such an arrangement will be enhanced by a slip-coupling to be formed as part of cap neck 97 (not herein specifically shown) to enable cap 95 to be rotated without rotating the outer portion of cap neck 97, to avoid twisting can liner 102.

Yet another venting arrangement involves the use of a cap vent valve 103 shown in FIG. 14 as part of modified cap 95. Cap vent valve 103 may be closed off by a friction-fit cover or may employ a threaded valve body enabling opening and closing thereof, in any number of well known fashions. Cap vent valve 103 would communicate with the interior of can 91 but not the interior of can liner 102.

As shown in FIG. 13, a dip tube or straw 104 is shown, being liquid-tightly secured to cap neck 97. Dip tube 104 is weighted at its distal end to position said end beneath the level of liquid maintained in can liner 102.

Figure 15:
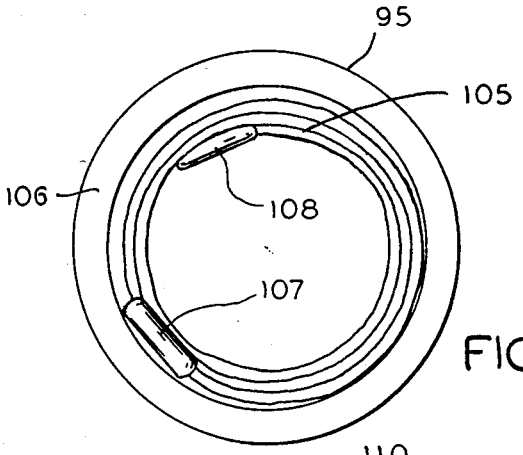
FIG. 15 is a view of the underside of the cap shown in FIG. 14 showing the transfer tube coiled and stored within.

Referring now to FIG. 15, an auxiliary supply tube 105 is therein shown coiled to fit within the well formed by the upstanding cap wall 106 of cap 95. Preferably, auxiliary supply tube 105 has a pair of cap drink pins 107 and 108 fluid-tightly attached to each end. Auxiliary supply tube 105 is intended to enable the connection of the interior of can liner 102 with either mask 10 or canteen 40 in an emergency situation. Use of auxiliary supply tube 105 may be made to refill canteen 40 in much the same manner as heretofore discussed. As an example, supply tube drink pin 107 may be coupled to cap 95 via plug 96, while supply cap pin 108 may be inserted to plug 21 of canteen 40. Can 91 may thereafter be elevated or tipped to provide a gravity flow sufficient to refill canteen 40. It should be noted that this situation contemplates the exhaustion of canteen 40 via the drinking techniques described hereinabove utilizing bulb 15 such that a vacuum or partial vacuum is drawn within canteen 40. It necessarily follows that the filling of a non-collapsed yet emptied canteen 40 will require the exhaustion of air therefrom if the filling is to be carried out under contaminated conditions.

Figure 16:
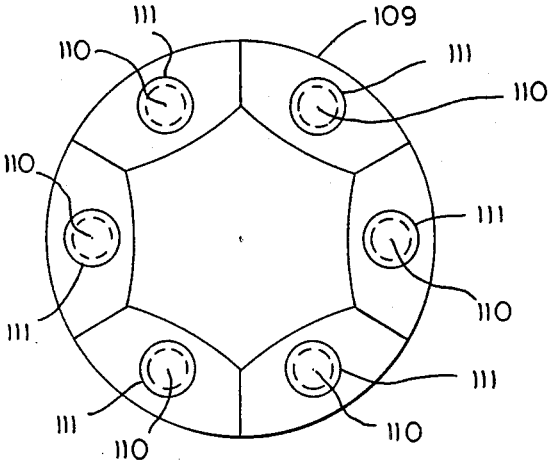
FIG. 16 is a top plan view of a preferred cap for use with the liner of FIG. 13 showing multiple pin receiving plugs.

Referring now to FIG. 16, a second modified cap 109 is shown with a multiplicity of drink pin receiving plugs 110 herein shown covered by protective covers 111. Such a construction is intended to provide multiple connection capabilities to allow the simultaneous withdrawl withdrawal of liquid from can liner 102 by more than one user.

Figure 17:
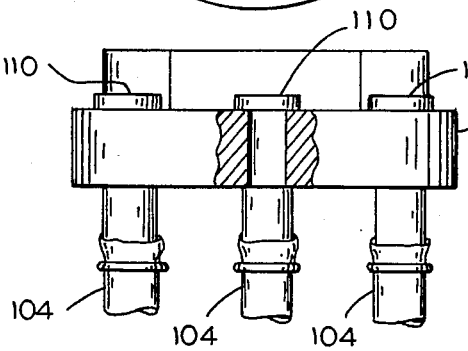
FIG. 17 is a front view in partial section of the cap shown in FIG. 16.

Referring now to FIG. 17, a partial sectional view of a preferred embodiment of cap 109 shows that a separate dip tube or straw 104 is fluid-tightly attached to each pin receiving plug 110. Thus, for example, six users may connect to cap 109 to provide potable fluid directly to four separate protective masks. Alternatively, cap 109 may be used to simulatenously refill six canteens. It is understood that the number of individual pin receiving plugs 110 may vary with the cap size and other design considerations.

While can 91 is typically blow molded from heavy density polyethylene, it is preferred that the modified caps 95 and/or 109 have been manufactured from a metallic substance, such as aluminum to provide more precise machining capabilities in order to locate, seat, and secure such mechanical components as pin receiving plugs 110, vent plug 103, and cap neck 97.

Figure 18:
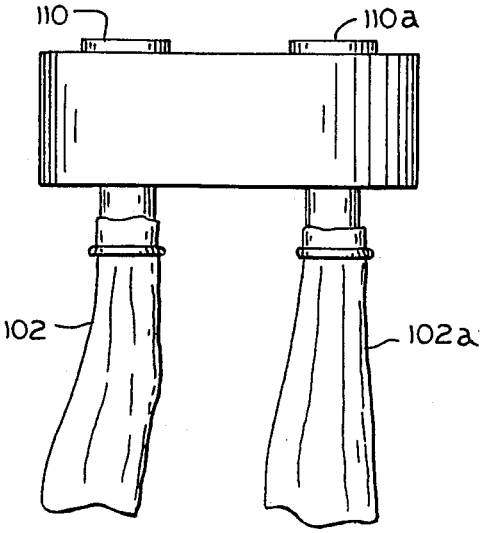
FIG. 18 is a partial elevation view of yet another preferred embodiment illustrating the connection of multiple bag liners thereto.

Yet another embodiment of the present invention uses multiple can liners 102 connected in such a way as to provide different potable liquids from different pin receiving plugs 110a. As an example, an additional liner 102a, as shown in FIG. 18, may contain a nutrient solution, an antibiotic solution, a medication such as an anti-emetic or anti-nausea agent, or the like.

It is also contemplated that the interior of can 91 may be pressurized, as discussed hereinabove, to provide additional impetus for fluid flow out of can liner 102.

When used under contaminated conditions, all fittings and connections will be decontaminated using a suitable decontamination kit prior to connection. Use of such kits, and access to larger reservoirs of safe drinking fluids will enable successive refillings of can liner 102 without exposing said liner to atmosphere-borne conditions of contamination. It should also be noted that the check valve arrangement present in the protective mask drinking supply system will prevent the back flow of any liquid which has reached the mouth of a user, thus preserving the drinking liquid within can liner 102 in a sanitary condition.

Figure 19:
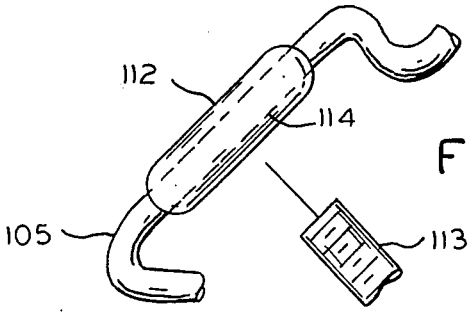
FIG. 19 is a plan view showing a site along a canteen supply tube at which drugs, medicines, nutrients, or other injectable material may be introduced.

Referring now to FIG. 19, there is shown an injection module 112 intended to be formed in-line with supply tube 105, or supply tube 19, to enable the in-line injection of medicines and or food supplements, such as via syringe 113. This type of arrangement may prove beneficial if, for example, a user does not mask in sufficient time to avoid the initial effects of a chemical agent. Under these conditions, an immediate injection of a medication such as atropine may be required. It is contemplated that module 112 will be formed from a sufficiently strong polyethelene or polypropylene material which will enable the insertion thereof of syringe 114 and will thereafter fluid-tightly seal when the syringe is withdrawn. It is also contemplated that module 112 can be fashioned in the form of a bulb which maintains a charge of medication which may be released into the supply line by crushing a portion of the inner structure of the bulb, such as frangible inner liner 114. This will free an emergency dose of medication without requiring the use of a syringe or other outside injection apparatus such as a hypodermic spray unit.

Figure 20:
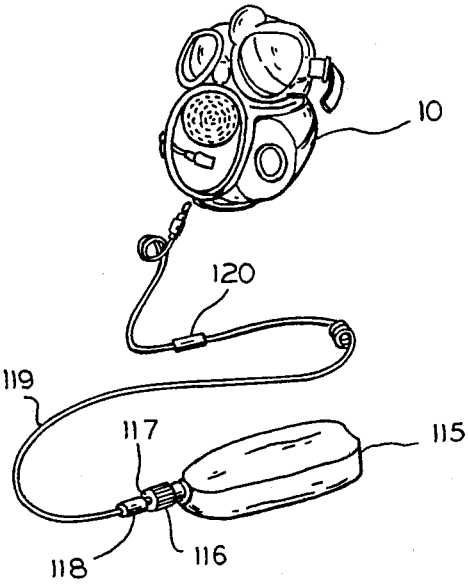
FIG. 20 is a plan view of an embodiment of the present invention allowing the transport and ingestion of fluid without use of the bulb pump.

Referring now to FIG. 20, the numeral 115 indicates generally a canteen known by the common designation as the two-quart desert canteen. Canteen 115 is characterized by a thin-walled construction which makes the canteen extremely light in weight and capable of being compressed by hand to collapse the canteen. As another preferred embodiment of the present invention, canteen 115 is furnished with a cap 116 having a drink pin receiving plug 117 into which a drink pin assembly 118 may be fluid-tightly inserted as described elsewhere herein. A supply tube 119, fluid-tightly attached to pin 118 has a check valve 120 positioned intermediate canteen cap 116 and mask 10. In the absence of a bulb to motivate the drinking fluid from the canteen to the mask, fluid flow to the user may be established by squeezing canteen 115 with a sufficient force to drive the fluid through supply tube 119 and downstream of check valve 120, where it may be ingested by the user. A similar flow of liquid may be established by connecting pin 118 to a pressurized reservoir as the source of liquid.

Figure 21:
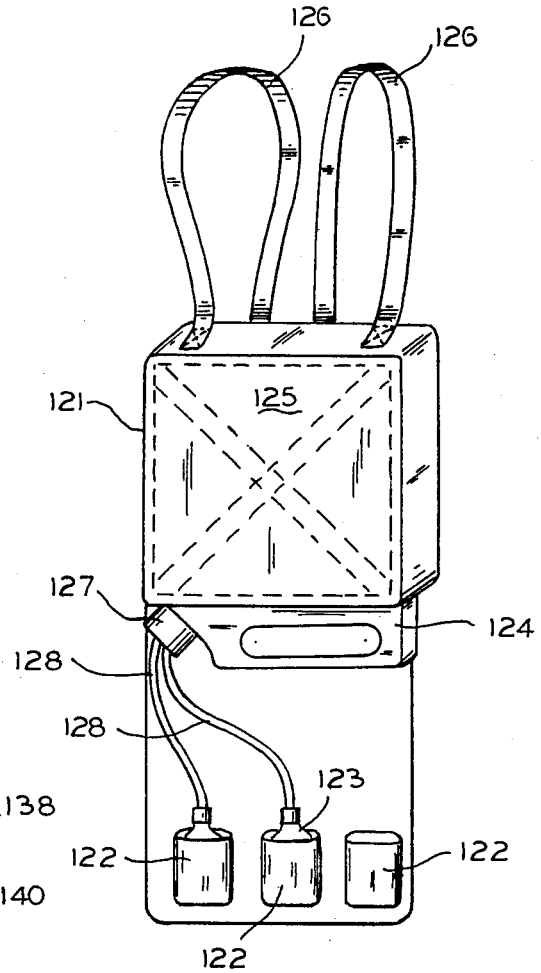
FIG. 21 is a plan view of a carrier and canteen holder used to refill canteens from a water can.

Referring now to FIG. 21, the numeral 121 indicates generally a harness having a plurality of pockets 122 sized and dimensioned to receive and hold a canteen 123 to be refilled from water can 124. A preferred embodiment of harness 121 includes a bag or body 125 within which can 124 may be held in an inverted position, using straps 126 which may be attached to a post, tree limb, or the like, or which may be used to mount the can to a user's back, much as a knapsack is mounted. Canteens such as 123 may then be placed in individual pockets 122 and connected to cap 127 of can 124 via supply tubes 128, as described hereinabove, allowing canteen 123 to be conveniently filled by gravity flow of liquid from can 124 via tubes 128. Additional pockets may be provided to store replacement supply tubes, decontamination supplies, medicines, and other items intended for use with the water supply system. When can 124 is emptied, it may be replaced by a full can. It is understood and intended that the can 124 herein illustrated is constructed to utilize the aspects of the present invention as set forth hereinabove.

Figure 22:
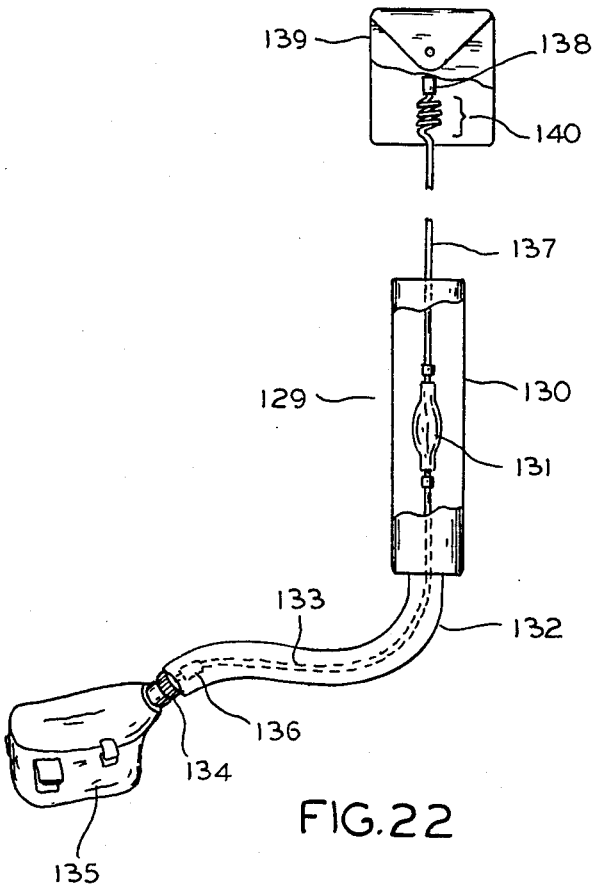
FIG. 22 is another embodiment of the protective sheath assembly shown in FIG. 8.

Referring now to FIG. 22, the numeral 129 indicates generally a modified version of the protective sheath 51 shown in FIG. 8. Sheath assembly 129 includes a bulb sleeve 130 within which bulb 131 is disposed and protected. A supply sleeve 132 is attached to the lowermost portion of bulb sleeve 131, covering and protecting supply tube 133 therewithin. The lowermost portion of supply sleeve 132 overlaps and is secured to cap 134 of canteen 135. To connect supply line 133 to canteen 135, supply sleeve 132 is drawn back to reveal drink pin 136 which is then inserted into cap 134 as described hereinabove.

Mask tube 137 extends upward from bulb 131 to mask connector assembly 138 which, in turn, is connectable to the drinking tube of the protective mask as set forth hereinabove. A protective pocket, 139 openable at the top, houses connector assembly 138 and a segment 140 of mask tube 137. A preferred embodiment of segment 140 is tightly coiled to retain segment 140 and connector assembly 138 normally within pocket 139. When connector assembly 138 is withdrawn form pocket 139 to be connected to a protective mask, segment 140 is stretched and stressed. When connector assembly 138 is disconnected and released, it resiliently regains its coiled configuration and is withdrawn automatically into pocket 139.

It is contemplated that bulb sleeve 130 and pocket 139 will ordinarily be attached to a user's field suspenders (not herein shown) by laces, clips, or the like. It is further contemplated that supply sleeve 132 be attachable to bulb sleeve 130, as by hook-and-loop fasteners when drink pin 136 is disconnected from cap 134. In this fashion, the entire connecting apparatus extending from canteen 135 to the protective mask may be carried on and maintained with the user's field suspenders as a single unit, conveniently and quickly attachable to the mask and the canteen in the event that contaminated conditions occur. It is further contemplated that, once connected, connector assembly 138 and segment 140 will be covered and protedted by a skirt 141 depending from mask 10 as shown in FIG. 6.

While the foregoing has presented various embodiments of the present invention, such embodiments are exemplary only, and are not intended to limit the spirit and scope of the invention. It is expected that others will perceive variations which, while varying from the foregoing, do not depart from the spirit and scope of the invention as herein described and claimed.

I claim:

1. Apparatus for introducing a liquid into a liquid-tight system, said system of the type including a protective mask having a drinking mouthpiece assembly on the interior thereof, positionable at the mouth of a user for ingestion of said liquid, a portable canteen for the initial storage of a quantity of said liquid, a mask connector joined to said drinking mouthpiece assembly, a canteen connector joining said mask connector to said canteen, and a hand pump to which said mask connector and said canteen connector are attached, said apparatus comprising:

means for storing a quantity of said liquid without exposing said liquid to the atmosphere;

means for liquid-tightly coupling said storage means to said mask connector to create a closed delivery path for said liquid from said storage means to said drinking mouth piece assembly; and means for selectively refilling said canteen from said storage means, said refilling means including means to couple said canteen connector to said storage means to create a closed, liquid-tight, delivery path for said liquid from said storage means to said canteen.

2. The apparatus as recited in claim 1 wherein said storage means includes a flexible, impermeable storage bag within which said liquid is disposed, said mask connector coupling means and said canteen connector coupling means being air-and-liquid-tightly attached to said bag.

3. The apparatus as recited in claim 2 wherein said bag has a bottom, and said mask connector coupling means and said canteen connector coupling means are attached to said bag at said bottom.

4. The apparatus as recited in claim 1 wherein said mask connector coupling means includes means for pumping said liquid from said storage means to said drinking mouthpiece assembly.

5. The apparatus as recited in claim 1 wherein said canteen connector coupling means includes means for pumping said liquid from said storage means to said canteen.

6. The apparatus as recited in claim 1 wherein said refilling means further includes means for creating a positive pressure differential between said storage means and the interior of said canteen.

7. The apparatus as recited in claim 6 wherein said pressure differential means includes means for increasing the pressure within said storage means to exceed atmospheric pressure.

8. The apparatus as recited in claim 1 wherein said refilling means further includes means to vent said canteen during refilling.

9. The apparatus as recited in claim 8 wherein said venting means includes means for allowing filtered atmospheric air to enter said canteen.

10. The apparatus as recited in claim 8 wherein said venting means includes means to exhaust air within said canteen to the atmosphere as said canteen is being filled, said exhausting means including a filter interposed between the atmosphere and the interior of said canteen.

11. The apparatus as recited in claim 10 wherein said venting means further includes means to prevent said liquid from reaching said filter after said canteen is filled.

12. The apparatus as recited in claim 2 wherein said storage means further includes a rigid container shaped and dimensioned to receive said bag when said bag is filled with said liquid.

13. The apparatus as recited in claim 12 wherein said container is divided into two compartments, an upper compartment and a lower compartment, said upper compartment shaped and dimensioned to accommodate said bag;

said lower compartment shaped and dimensioned to accommodate said mask connector coupling means and said canteen connector coupling means.

14. The apparatus as recited in claim 13 wherein said case further includes means for manually carrying said storage means.

15. The apparatus as recited in claim 1 further including a plurality of said mask connector coupling means and said canteen connector coupling means.

16. Apparatus for introducing a liquid into a system, said system of the type including a protective mask having a drinking mouth piece assembly on the interior thereof, positionable at the mouth of a user for ingestion of said liquid, a portable canteen for the storage of an initial quantity of said liquid, a connecting tube extending from said canteen to said drinking mouth piece assembly, a mask connector joining said connecting tube to said drinking mount piece assembly, and a canteen connector joining said connecting tube to said canteen, said apparatus comprising:

a flexible, impermeable storage bag within which said liquid is disposed without exposing said liquid to the atmosphere;

at least one first coupling formed liquid-tightly on said storage bag, each of said first coupling adapted to selectively and liquid-tightly receive one said mask connector;

means for selectively refilling said canteen from said bag, said refilling means including at least one second coupling formed liquid-tightly on said bag, each said second coupling adapted to selectively and liquid-tightly receive one said canteen connector, said bag, one said first connector, and said mask connector creating a closed delivery path for said liquid from said bag to said drinking mouth piece assembly; and said bag, one said second connector, and said canteen, creating a closed delivery path for said liquid from said bag to said canteen.

17. The apparatus as recited in claim 16 wherein said first coupling means includes means for pumping said liquid from said storage means to said drinking mouthpiece assembly.

18. The apparatus as recited in claim 16 wherein said second coupling means includes means for pumping said liquid from said storage means to said canteen.

19. The apparatus as recited in claim 16 wherein said refilling means further includes means for creating a positive pressure differential between said bag and in the interior of said canteen.

20. The apparatus as recited in claim 19 wherein said pressure differential means includes means for increasing the pressure within said bag to exceed atmospheric pressure.

21. The apparatus as recited in claim 16 wherein said refilling means further includes means to vent said canteen during refilling.

22. The apparatus as recited in claim 21 wherein said venting means includes means for allowing filtered atmospheric air to enter said canteen.

23. The apparatus as recited in claim 21 wherein said venting means includes means to exhaust air within said canteen to the atmosphere as said canteen is being filled, said exhausting means including a filther interposed between the atmosphere and the interior of said canteen.

24. The apparatus as recited in claim 22 wherein said venting means further includes means to prevent said liquid from reaching said filter after said canteen is filled.

* * * * *